US005586399A

United States Patent [19]

Staroselsky

[11] Patent Number: 5,586,399

[45] Date of Patent: Dec. 24, 1996

[54] VERTICAL TRENCHER APPARATUS EMPLOYING CUTTER HAVING HELICAL CHANNEL OF VARYING RISE ANGLE

[75] Inventor: Semeon Staroselsky, Tel Aviv, Israel

[73] Assignee: V.T.S. Trenching Systems Ltd., Yavne, Israel

[21] Appl. No.: 517,697

[22] Filed: Aug. 22, 1995

[51] Int. Cl.[6] ..... E02F 3/06

[52] U.S. Cl. ..... 37/351; 37/347; 175/394

[58] Field of Search ..... 37/349, 351, 352, 37/353, 354, 355, 356, 357, 358; 299/87.1, 68; 175/394

[56] References Cited

U.S. PATENT DOCUMENTS

| | | | |
|---|---|---|---|
| 785,302 | 3/1905 | Fullard | 37/351 |
| 799,753 | 9/1905 | O'Connor | 37/351 |
| 1,586,151 | 5/1926 | Hess | 299/87.1 |
| 2,201,159 | 5/1940 | Clow | 175/394 |
| 2,237,383 | 4/1941 | Agostineto | 175/394 |
| 2,545,016 | 3/1951 | Berry | 37/351 |
| 3,226,855 | 1/1966 | Smith | 299/87.1 X |
| 3,864,923 | 2/1975 | Turzillo | 175/394 X |
| 4,087,131 | 5/1978 | Peterson et al. | 299/87.1 X |
| 4,247,997 | 2/1981 | Paurat et al. | 37/351 |
| 4,249,779 | 2/1981 | Best et al. | 299/87.1 X |
| 4,718,537 | 1/1988 | Miller | 37/351 X |
| 4,986,375 | 1/1991 | Maher | 175/394 X |
| 5,096,344 | 3/1992 | Fischer | 175/394 X |
| 5,465,511 | 11/1995 | Umberson | 37/351 X |
| 5,487,434 | 1/1996 | Obermeier | 175/394 X |

FOREIGN PATENT DOCUMENTS

| | | | |
|---|---|---|---|
| 69152 | 6/1951 | Austria | 37/351 |
| 902104 | 10/1985 | Belgium . | |
| 1005788 | 1/1994 | Belgium . | |
| 2566024 | 12/1985 | France . | |
| 60-250129 | 12/1985 | Japan . | |
| 457777 | 3/1975 | U.S.S.R. . | |

*Primary Examiner*—Terry Lee Melius
*Assistant Examiner*—Victor Batson
*Attorney, Agent, or Firm*—Edward Langer; Mark M. Friedman

[57] ABSTRACT

A vertical trencher having a cutter body with cutting teeth arranged in a spiral configuration on its circumference with an increasing rise angle, for excavating various size trenches, which is operable at high speed and efficiency, and suitable for use on hard and rocky ground. The cutter body is formed with a spiral-shaped concave channel, with grinding teeth attached to its outer edge. The grinding teeth cut soil and rock loose, so that pieces are scooped into the concave channel. The rise angle of the concave channel to the horizontal increases along the length of the cutter body. Thus, loose pieces of soil are transported upwardly along the concave channel at an increasing axial speed. The cutter body is connected at its upper end to a hydraulic engine mounted on the housing, which provides rotational power. The combination of centrifugal force and increased axial speed developed by rotation of the cutter body causes the transported soil to be thrown from the concave channel through the aperture in the housing, above the trench. Advantages of the cutter body design include its use as a single moving part, which simplifies its construction and operation, while reducing cost. The cutter body has reduced contact area with the soil, which reduces the rotational power required.

4 Claims, 2 Drawing Sheets

VERTICAL TRENCHER APPARATUS EMPLOYING CUTTER HAVING HELICAL CHANNEL OF VARYING RISE ANGLE

FIELD OF THE INVENTION

The present invention relates to excavating equipment and the like, and more particularly, to a vertical trencher having a cutter body with cutting teeth arranged in a spiral configuration on its circumference for high speed operation.

BACKGROUND OF THE INVENTION

Trench excavation for purposes of installing an underground utility infrastructure is an essential and common activity of any ground development work. The common applications are for various kinds of piping, communications, energy etc. There are different types of digging equipment, and each has its advantages and disadvantages. The common denominator with all equipment manufacturers of mechanical digging equipment is the search for solutions that enable more efficient digging and reduction of the limitations connected with ground hardness.

There are two types of equipment in use today, excavators and trenchers. Excavators have a jointed arm powered hydraulically, with a digging tool at one end. The advantage of these machines lies in the fact that they are universal and flexible in the type of digging they can achieve. However, they are not efficient as they do not operate continuousiy, and require three movements, a first movement for digging, a second for removing the soil from the trench and dumping it along the sides of the trench, and a third for returning to the trench for digging. Thus, the effective digging time is approximately only 30% of working time.

Additionally, these machines do not move while digging. At the end of a digging cycle, depending on the length of the arm, they must be re-positioned. For this reason, the total effective digging time is reduced below 30% of the working time.

An additional limitation of these machines is the ground cutting speed of the digging tool. The speed is very low and thus the digging tool requires a large force to split the ground, and must be very heavy. For these reasons, these machines have difficulty digging into hard and rocky ground.

It is possible to equip excavators with a hydraulic hammer to break the rocks, after which another pass is required to clean the trench. Clearly, these extra operations greatly increase the excavation cost.

Trenchers operate in continuous fashion, thus saving valuable working time. The major disadvantages of these machines are that the digging systems are assembled from a large number of moving parts and chains including a separate soil removal system. Multiplication of systems and moving parts reduces the efficiency and technical reliability, while increasing the price. Further, since trenchers have a large contact area with the ground, and cut on a diagonal, they require large amounts of power, force and weight for digging operations.

Other types of trenchers include those having a large digging wheel with cutting teeth. These machines are limited in their cutting depth which is always less than the wheel radius. This type of trencher also has a large contact area with the ground, and since the wheel is driven from its center, large amounts of power and large moments of force are required for digging operations. An additional soil removal system is required.

Examples of patents disclosing trench excavation equipment include Japanese Patent No. 60-25-129 to Miwa, in which a drum-shaped cutter is pivotally supported on the front of a traveler with a conveyer to carry excavated soil to the rear.

Russian Patent 457777 to Kudra discloses a trench excavator device having inclined knives attached to a screw conveyor, facing the spiral direction to improve operation.

French Patent 2,566,024 to Corneille discloses a narrow trench digger with vertical rotating auger, with a parallel partition behind, equipped with soil loosening tools, such as vibrating vertical toothed bars, teeth on the auger spirals, or vertical rotary cutters.

Belgian Patent 902104 to Durieux discloses a trench cutting machine having a rotating tool comprising a pipe on which a flat is spiral wound or threaded with cutting or abrasive pieces. The trench cutting machine propels itself along the ground via a winch. Belgian Patent 1005788 to Durieux discloses a rotary trench cutter with a detachable vertical partition, to produce trenches of different sizes.

Therefore, it would be desirable to provide a trencher for excavating various size trenches, which operates at a high speed with increased capability for use on hard and rocky ground.

SUMMARY OF THE INVENTION

Accordingly, it is a principal object of the present invention to overcome the disadvantages of prior art excavation systems and provide a vertical trencher having a cutter body with cutting teeth arranged in a spiral configuration on its circumference with an increasing rise angle, for excavating various size trenches, which is operable at a high speed and suitable for use on hard and rocky ground.

In accordance with a preferred embodiment of the present invention, there is provided vertical trencher apparatus for rock and soil excavation of a trench comprising:

a platform;

a housing attached to said platform, said housing having an aperture near its upper end; and a rotational power source mounted on said housing, a shaft of said rotational power source being connected to a cutter body having a spiral-shaped concave channel formed on its circumference, an outer edge of said concave channel having attached thereto cutting teeth, said spiral-shaped concave channel defining a rise angle with the horizontal, said rise angle increasing along the length of said cutter body from a lower end to an upper end thereof, such that during operation within the trench, said cutting teeth rotate and grind against the soil and rock, causing pieces thereof to fall into said spiral-shaped concave channel, said pieces being transported upwardly at an increasing axial speed during rotation, and being thrown out of said concave channel via said aperture above the sides of the trench.

In the preferred embodiment, the cutter body is formed with a spiral-shaped concave channel, with grinding teeth attached to its outer edge. The grinding teeth cut soil and rock loose, so that pieces are scooped into the concave channel. The rise angle of the concave channel to the horizontal increases along the length of the cutter body. Thus, loose pieces of soil are transported upwardly along the concave channel at an increasing axial speed. The cutter body is connected at its upper end to a hydraulic engine mounted on the housing, which provides rotational power. The combination of centrifugal force and increased axial speed developed by rotation of the cutter body causes the transported soil to thrown from the concave channel be through the aperture in the housing, above the trench.

The advantages of the inventive excavation apparatus are based on use of the cutter body as a single moving part. This simplifies the construction and operation of the apparatus, while reducing cost. The cutter body has reduced contact area with the soil, which reduces the rotational power required. The increasing rise angle maximizes the effectiveness of the cutter body since the accumulated soil from its lower regions rises at an increasing axial speed without slowing rotation. The concave shape of the channel enables larger amounts of soil to be removed with minimal friction with the trench sides, so that a separate soil removal system is not required. The apparatus is designed with a back cover to prevent the soil return into the trench.

Other features and advantages of the invention will become apparent from the following drawings and description.

BRIEF DESCRIPTION OF THE DRAWINGS

For a better understanding of the invention with regard to the embodiments thereof, reference is made to the accompanying drawings, in which like numerals designate corresponding elements or sections throughout, and in which.

DETAILED DESCRIPTION OF A PREFERRED EMBODIMENT

Figure 1:
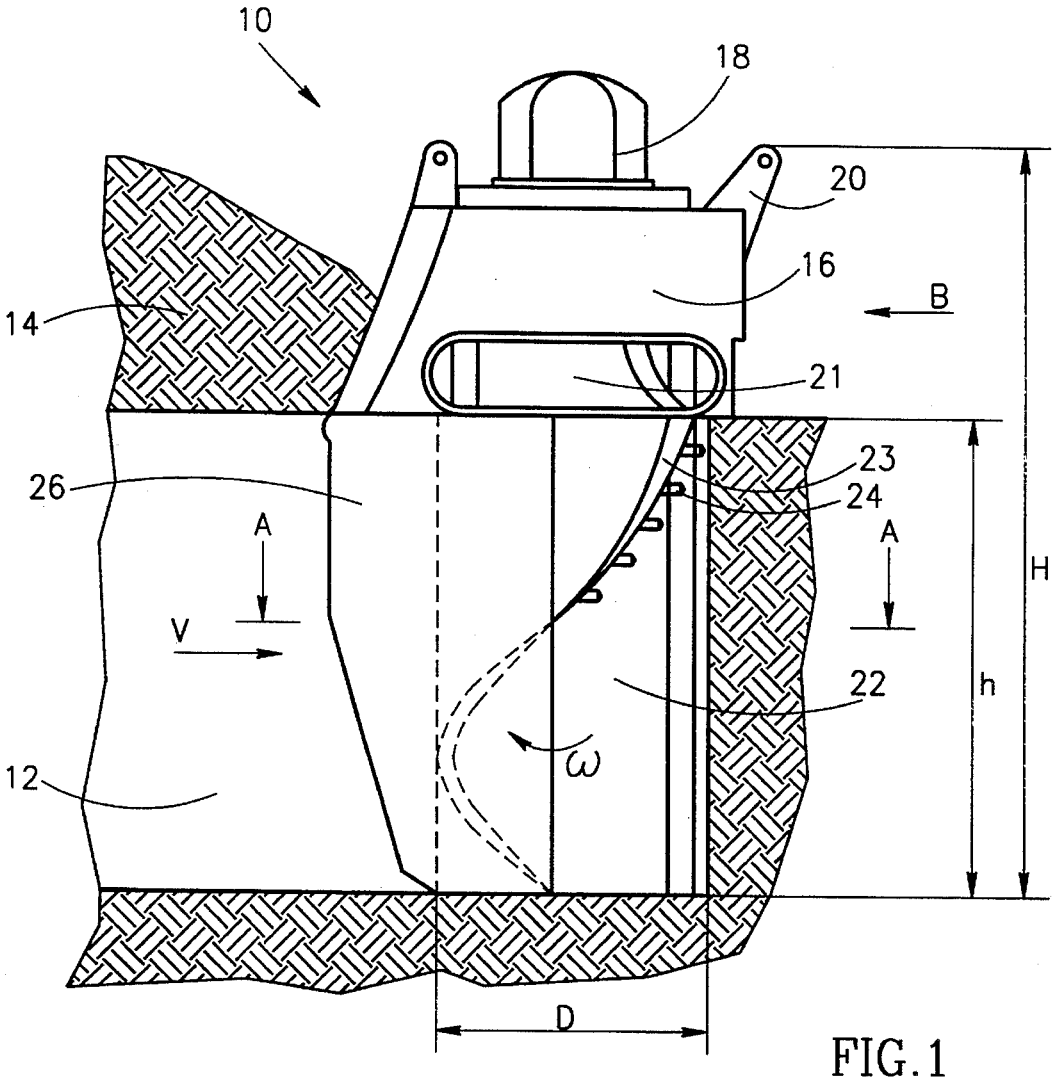
FIG. 1 is a schematic illustration of a vertical trencher apparatus constructed and operated in accordance with a preferred embodiment of the present invention.

Referring now to FIG. 1, there is shown a schematic illustration of a vertical trencher apparatus 10 constructed and operated in accordance with a preferred embodiment of the present invention. Apparatus 10 is shown disposed in a trench 12 from which soil 14 has been excavated, and apparatus 10 is illustrated in motion from left to right, at velocity V (arrow). Apparatus 10 comprises a vertically oriented housing 16 having an upper end arranged for connection to a rotary power source 18. Housing 16 is connected to a platform, e.g. a tractor, via links 20.

The upper end of housing 16 has an aperture 21 formed therein for soil removal during excavation operations. Extending from the lower end of housing 16 is a cutter body 22 having a concave channel 23 formed along its circumference, and arranged in a spiral configuration. Concave channel 23 has attached to its outer edge cutting teeth 24, which grind and loosen soil 14 and rock. A back cover 26 which is attached to the lower end of housing 16 encloses the rear of cutter body 22 and extends along its height into the trench 12, thereby increasing stability and preventing return of excavated soil. Cutter body 22 rotates as shown (arrow) at rotational speed.

Cutter body 22 may be designed with sample dimensions as illustrated in FIG. 1, such that its diameter D is in the range of 0.4–1 meter, and its height h is in the range 0.4–2 meter, with an overall height H including housing 16 of 1.3–2.5 meter. The cutter body 22 weight is in the range of 500–1000 kg.

Figure 2:
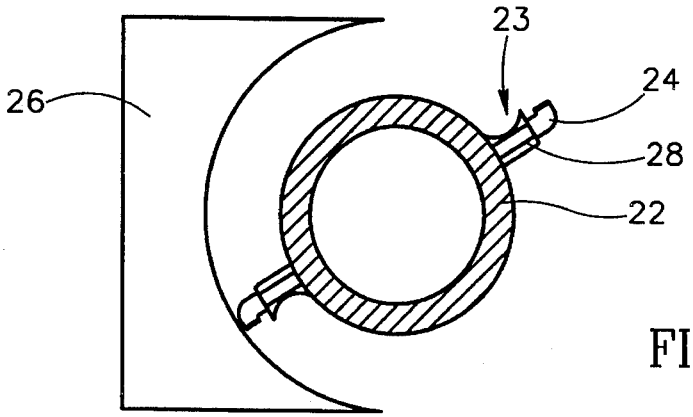
FIG. 2 is a cross-sectional top view of a cutter body and back cover taken along section lines A—A of FIG. 1.

Referring now to FIG. 2, there is shown a top cross-sectional view of cutter body 22 taken along section lines A—A of FIG. 1 On the outer face 28 of concave channel 23 there are attached cutting teeth 24 which, as mentioned previously, grind and cut soil and rock 14 loose, so that pieces are scooped into the concave channel 23. As described further herein, in accordance with the invention, concave channel 23 is shaped as a spiral with an increasing rise angle, enabling cutter body 22 to operate at a high speed and making it suitable for use on hard and rocky ground.

Figure 3:
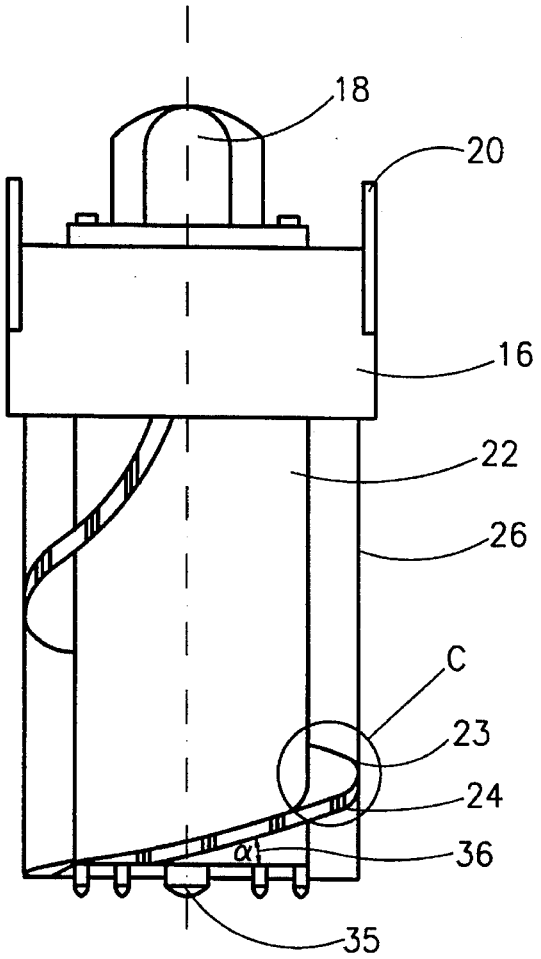
FIG. 3 is an end elevation view of the trencher apparatus as viewed from the direction B indicated in FIG. 1.
Figure 4:
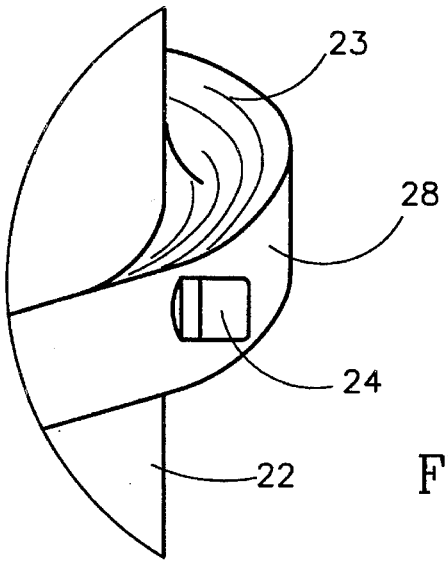
FIG. 4 is an enlarged detail view (C) of a concave channel formed in the cutter body shown in FIG. 3.

FIGS. 3–4 are, respectively, an end elevation view and an enlarged detail view (C) of the cutter body 22 as viewed from the direction B indicated in FIG. 1. As shown, housing 16 has links 20 for connecting It to a platform, such as a tractor, which provides a supply of hydraulic power, to the rotary power source 18. Housing 16 is stationary, while cutter body 22 rotates therein, driven by rotary power source 18. A lower end of cutter body 22 has attached thereto lower end cutting teeth 35.

Concave channel 23 is shown having a spiral shape projecting externally from the circumference of cutter body 22. Concave channel 23 is indicated as having a rise angle 36 ($\alpha$) in relation to the horizontal. As the spiral rises, the value of this angle increases so that near the top of cutter body 22 a steep angle is provided. The increasing rise angle enables the trenching operation to proceed at a maximum rate, since the accumulated soil removed by lower regions of cutter body 22 rises within concave channel 23 at a faster axial speed without slowing rotation. Thus, the additional soil removed by the upper regions of cutter body 22 does not slow the cutter body 22 in its operation, increasing the overall output of trencher apparatus 10.

The inventive spiral-shaped concave channel 23 reduces the friction between cutter body 22 and the trench 12 being excavated, since there is reduced friction between the excavated soil and the trench. The soil is transported upwardly within concave channel 23 at an increasing axial speed, and the combination of centrifugal force and increased axial speed throws the excavated soil out of the trench 12 via aperture 21, thus eliminating the need for a separate soil removal apparatus. The overall design cost is thus reduced while output is increased.

Advantages of the vertical trencher design include:

1) the excavation and removal procedures are carried out by a single element, the cutter body, enabling design simplification and reduced cost;
2) minimum contact area is developed between the soil and the vertically-oriented trencher, which increases the power on the effective area, thereby enabling its use on hard and rocky ground;
3) the cutting teeth 24 and spiral shape of concave channel 23 are provided with an increasing rise angle which enables an equivalent cutting rate at each depth of the trench, to optimize the excavation procedure and increase the effectiveness and rate;
4) the spiral, concave channel 23 and increasing rise angle allow a greater volume of soil to be excavated by minimizing friction of the cutter body with the trench;
5) the increasing rise angle provides the excavated soil with increased axial speed for purposes of throwing it out of the trench, eliminating the need for separate soil removal apparatus;

6) the rear cover prevents return of soil into the trench, while being supported by the trench sides to provide stability.

Having described the invention with regard to certain specific embodiments thereof, it is to be understood that the description is not meant as a limitation, since further modifications may now suggest themselves to those skilled in the art, and it is intended to cover such modifications as fall within the scope of the appended claims.

I claim:

1. A vertical trencher apparatus attachable to a moving platform carrying a power source for excavating rock and soil to form a trench, the apparatus comprising:

(a) a cutter body having:

(i) a substantially cylindrical surface having a lower end, an upper end and defined as having a longitudinal central axis, (ii) a ridge attached to, and extending outwardly from, said surface in a helical configuration extending continuously along said surface to said lower end, said ridge having an upper surface and an outer edge, said ridge being formed such that a rise angle at a point of said ridge proximal to said lower end of said surface is less than a rise angle at a point of said ridge proximal to said upper end of said surface, wherein said rise angle is defined at each point of said ridge as the angle between a virtual plane parallel to said upper surface at that point and a virtual plane perpendicular to said longitudinal axis, and (iii) a plurality of cutting elements deployed in fixed relation to said outer edge such that said cutting elements lie substantially on a virtual cylinder:

(b) a housing operatively engaged with said cutter body at said upper end so as to maintain said cutter body with said longitudinal central axis substantially vertical and to allow rotation of said cutter body about said longitudinal central axis, said housing having a lateral aperture;

(c) a power transmission associated with said cutter body at said upper end for employing power from the power source to generate rotation of said cutter body about said longitudinal central axis; and (d) a back cover mounted in fixed relation to said housing so as present an inner surface extending substantially along and partially circumscribing said cutter body.

2. A vertical trencher apparatus as in claim 1, wherein said rise angle is a minimum at said lower end of said cylindrical surface.

3. A vertical trencher apparatus as in claim 1, wherein said rise angle is a maximum at said upper end of said cylindrical surface.

4. A vertical trenching apparatus as in claim 1, wherein said rise angle increases monotonically from said lower end to said upper end of said cylindrical surface.

* * * * *